US007646355B2

(12) United States Patent
Bishop

(10) Patent No.: US 7,646,355 B2
(45) Date of Patent: Jan. 12, 2010

(54) ENCLOSURE WITH GROUND PLANE

(75) Inventor: Donald M. Bishop, Highlands Ranch, CO (US)

(73) Assignee: Sandwave IP, LLC, Berthoud, CO (US)

( * ) Notice: Subject to any disclaimer, the term of this patent is extended or adjusted under 35 U.S.C. 154(b) by 113 days.

(21) Appl. No.: 11/417,723

(22) Filed: May 4, 2006

(65) Prior Publication Data

US 2006/0250311 A1 Nov. 9, 2006

Related U.S. Application Data

(60) Provisional application No. 60/677,644, filed on May 4, 2005.

(51) Int. Cl.
*H01Q 1/42* (2006.01)

(52) U.S. Cl. ..... 343/872; 343/702

(58) Field of Classification Search ..... 343/702, 343/872

See application file for complete search history.

(56) References Cited

U.S. PATENT DOCUMENTS

| | | | | |
|---|---|---|---|---|
| 5,262,588 | A * | 11/1993 | Gallagher | 174/374 |
| 2002/0011953 | A1 * | 1/2002 | Reece et al. | 343/700 MS |
| 2003/0121686 | A1 * | 7/2003 | Barabash | 174/35 R |
| 2003/0169211 | A1 * | 9/2003 | Kawai et al. | 343/895 |

* cited by examiner

*Primary Examiner*—Trinh V Dinh
*Assistant Examiner*—Dieu Hien T Duong
(74) *Attorney, Agent, or Firm*—Krajec Patent Offices, LLC; Russell S. Krajec

(57) ABSTRACT

A system and method for mounting one or more radio antennas in an outdoor enclosure by placing a ground plane underneath the antennas and above any electrical devices. The ground plane may be used to mount the antennas in any configuration and be coupled to earth ground. In some embodiments, an outdoor enclosure may have a weatherproof radome mounted around the antennas.

28 Claims, 6 Drawing Sheets

ENCLOSURE WITH GROUND PLANE

CROSS REFERENCE TO RELATED APPLICATIONS

This application claims priority to and the benefit of U.S. provisional patent application Ser. No. 60/677,644 entitled "Enclosure With Ground Plane" filed May 4, 2005 by Donald M. Bishop, which is hereby expressly incorporated by reference.

BACKGROUND OF THE INVENTION a. Field of the Invention

The present invention pertains generally to electronics equipment enclosures and specifically to those enclosures housing a radio antenna.

b. Description of the Background

Communications equipment is deployed in many locations to satisfy society's seemingly insatiable thirst for communications bandwidth. No longer does a single phone line into a residence supply the connectedness, but cable television, high speed internet, and other communications media are standard in today's home or business.

Many devices are required to be deployed at or near a subscriber's location, sometimes housed in outdoor equipment boxes. These boxes are located adjacent to a residence or business and may house such equipment as fiber optic converters and amplifiers, coaxial cable devices, power supplies, switch boxes, and other devices. In many cases, the devices may radiate some radio frequency energy.

As wireless communication technology becomes more pervasive, adding wireless radios to the existing enclosures causes several problems, not the least of which are the potential electrical interferences between the radio and antenna system with other devices mounted in the enclosure.

It would therefore be advantageous to provide a system and method for constructing an equipment enclosure that enables high fidelity radio transmission while housing several other electrical devices, including devices that radiate potentially interfering RF energy.

SUMMARY OF THE INVENTION

The present invention provides a system and method for mounting one or more radio antennas in an outdoor enclosure by placing a ground plane underneath the antennas and above any electrical devices. The ground plane may be used to mount the antennas in any configuration and be coupled to earth ground. In some embodiments, an outdoor enclosure may have a weatherproof radome mounted around the antennas.

An embodiment may include an enclosure comprising: a lower equipment housing comprising at least one mounting device for an electrical device; a ground reference mounted substantially horizontally above the lower equipment housing and electrically connected with earth ground, the ground reference defining a substantially horizontal plane on the upper surface of the ground reference; and at least one antenna mounted above the ground plane; wherein the ground reference comprises a substantially flat portion beneath the at least one antenna, the flat portion having a plan area substantially larger than a plan area of the antenna, the ground reference being mounted such that all non-antenna conductive devices above the plane are connected to earth ground.

Another embodiment may include a network interface comprising: a lower equipment housing comprising at least one mounting device for an electrical device, the electrical device comprising an interface to a network; a ground reference mounted substantially horizontally above the lower equipment housing and electrically connected with earth ground, the ground reference defining a substantially horizontal plane on the upper surface of the ground reference; and at least one antenna mounted above the ground plane, the antenna adapted to send and receive communications to a network subscriber; wherein the ground reference comprises a substantially flat portion beneath the at least one antenna, the flat portion having a plan area substantially larger than a plan area of the antenna, the ground reference being mounted such that all non-antenna conductive devices above the plane are connected to earth ground.

DETAILED DESCRIPTION OF THE INVENTION

Specific embodiments of the invention are described in detail below. The embodiments were selected to illustrate various features of the invention, but should not be considered to limit the invention to the embodiments described, as the invention is susceptible to various modifications and alternative forms. The invention is to cover all modifications, equivalents, and alternatives falling within the spirit and scope of the invention as defined by the claims. In general, the embodiments were selected to highlight specific inventive aspects or features of the invention.

Throughout this specification, like reference numbers signify the same elements throughout the description of the figures.

When elements are referred to as being "connected" or "coupled," the elements can be directly connected or coupled together or one or more intervening elements may also be present. In contrast, when elements are referred to as being "directly connected" or "directly coupled," there are no intervening elements present.

Throughout this specification, the term "comprising" shall be synonymous with "including," "containing," or "characterized by," is inclusive or open-ended and does not exclude additional, unrecited elements or method steps. "Comprising" is a term of art which means that the named elements are essential, but other elements may be added and still form a construct within the scope of the statement. "Comprising" leaves open for the inclusion of unspecified ingredients even in major amounts.

Figure 1:
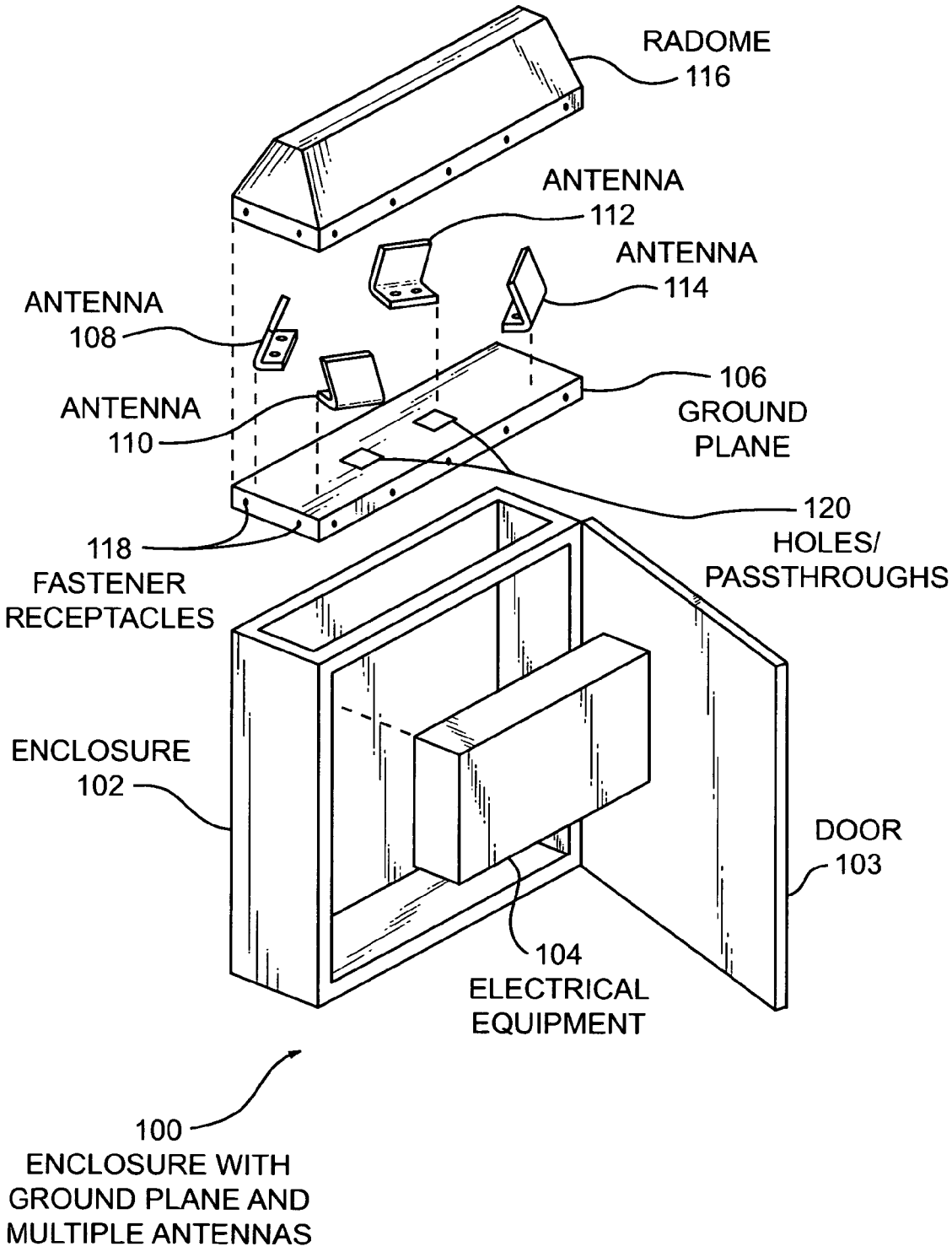
FIG. 1 is an exploded perspective view of an embodiment showing an enclosure with four antennas.
Figure 2:
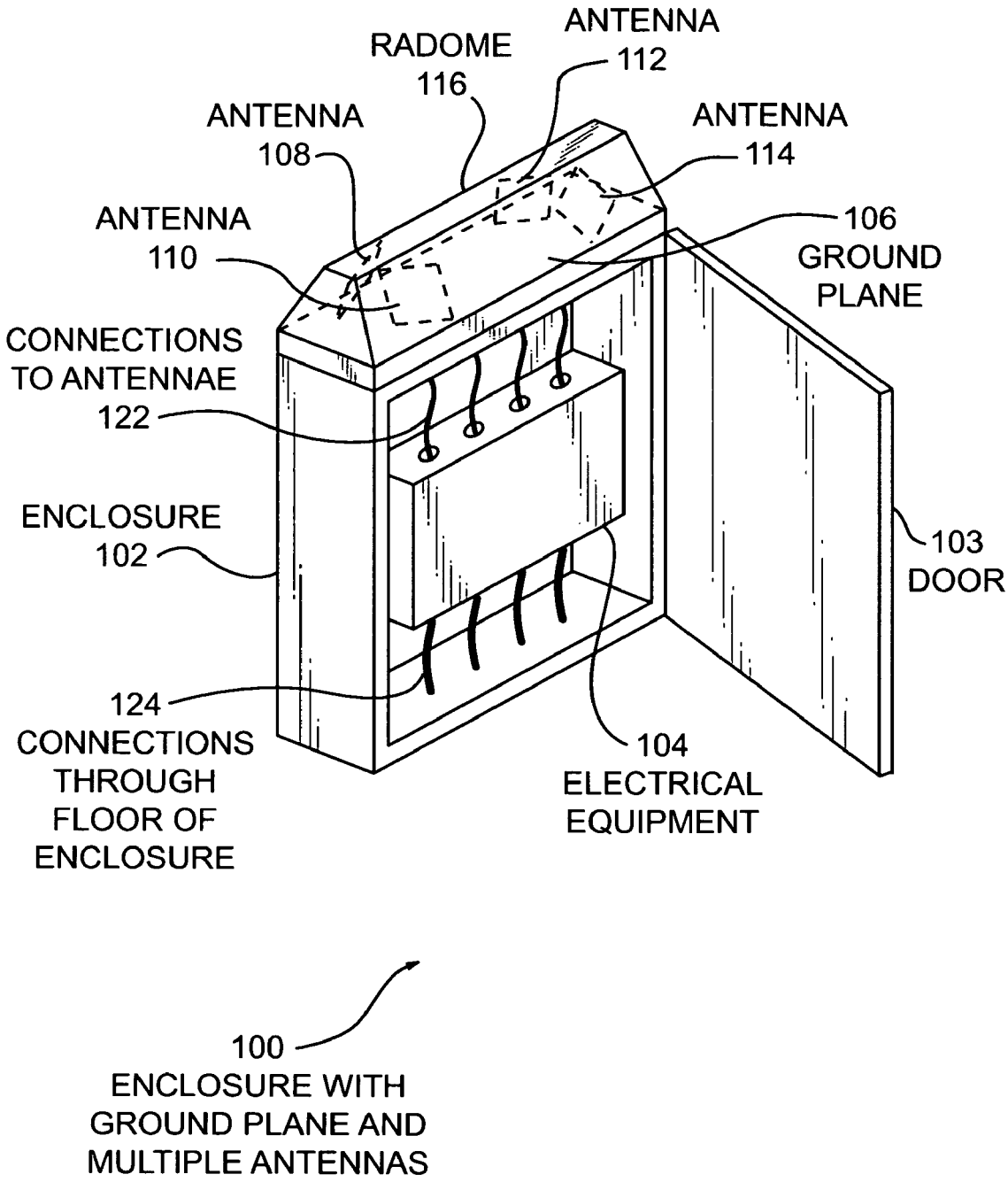
FIG. 2 is an assembled perspective view of the embodiment of FIG. 1.

FIGS. 1 and 2 illustrate an embodiment 100 showing an enclosure with a ground plane and multiple antennas. FIG. 1 is an exploded view while FIG. 2 is an assembled view of the same embodiment.

An enclosure 102 has a door 103 that houses some electrical equipment 104. Mounted to the top of the enclosure 102 is a ground plane 106 to which antennas 108, 110, 112, and 114 are attached. A radome 116 covers the antennae. The ground plane 106 may have fastener receptacles 118 as well as holes or passthroughs 120. The electrical equipment 104 may have several connections to antennae 122 as well as connections 124 through the floor of the enclosure.

The enclosure 102 may be made from either conductive or nonconductive material. For example, an embodiment for outdoor use may have an enclosure 102 fabricated from injection molded plastic, with or without filler or strengthening additives. In many cases, a molded enclosure 102 may not be fully conductive. Such enclosures are known in the art and are manufactured in many shapes and sizes.

The enclosure 102 may be manufactured from conductive material, such as metal or plastic material that has conductive filler or conductive coating applied. In some embodiments, a conductive mesh may be incorporated into one or more faces of the enclosure.

The door 103 may be of any type of access to the electrical equipment 104. The door 103 may be hinged or may be a removable access panel. In some embodiments, an enclosure may not have a door and may afford access to the electrical equipment 104 by some other means.

In embodiments where the enclosure 102 is made from a conductive material, the door 103 may also be manufactured from a conductive material. In such cases, a resilient electrically conductive interface such as a conductive gasket may be used around the periphery of the door 103 to make electrical contact between the enclosure 102 and the door 103.

The electrical equipment 104 may be any type of electrical equipment whatsoever. In some cases, a transformer, power supply, or various radio frequency (RF) devices may be present either separately or as part of a single device. Many devices, such as transformers, power supplies, RF devices, and other devices generate RF interference that may degrade the performance of nearby radios. This problem is exacerbated when the enclosure is also used for radio communications.

In a typical enclosure used for wireless communications, a network signal may be transmitted through a cable or fiber optic connection into the enclosure. Power supplies, converters, modems, and various electrical devices may process incoming signals and connect to one or more radio transceivers. The transceiver may connect to one or more antennas located above the ground plane 106.

In another enclosure used for wireless communications, power may be supplied from a hard wired direct connection through the bottom of the enclosure 102 to supply power to one or more radio transceivers in the enclosure 102. Such an embodiment may be useful in a system where the transceivers serve to relay communications from one antenna to another. The antennas may be directional antennas and arranged to receive transmissions from one area and transmit the signals to another area. In another embodiment, one antenna and transceiver may send and receive communications in a first frequency band using a first protocol which transfers the communications to a second antenna and transceiver in a second frequency band using a second protocol.

The ground plane 106 may be a substantially flat and generally horizontal conductive material. The ground plane 106 may shield the various antennae from interference from the electrical equipment 104. In some embodiments, the ground plane 106 may be manufactured from metal, including various steels, aluminum, brass, or other conductive metal. The ground plane 106 may be treated with a metallic or other conductive coating that may additionally provide corrosion protection.

In some embodiments, the ground plane 106 may be a nonconductive material that has a conductive treatment or coating. For example, injection molded plastic may be nonconductive but may be treated with a metallic conductive coating by spray application, plating, or any other mechanism.

In many embodiments, the substantially flat and substantially horizontal conductive upper surface of the ground plane 106 may provide shielding from the electrical equipment 104 as well as a ground plane for the various antennae.

The ground plane 106 may be connected to earth ground through direct connection to a grounded rod in the earth or through connection to a conductive mechanical frame within the enclosure 102. Other connections may also be used to connect the ground plane 106 to earth ground. In general, non-antenna but metallic items above the ground plane may be grounded.

The ground plane 106 may have several holes or passthroughs 120. Electrical connections between a radio transmitter within the enclosure 104 and the antennae may be made by passing a cable through the holes 120 or by installing a panel mounted connector or other electrical passthrough on the ground plane 106. In cases where the frequency of the radio signals is known, the size of the holes 120 may be selected to minimize transference of radio energy from the enclosure 102.

The ground plane 106 may prevent unwanted interference between noise or other energy generated within the enclosure 102 from interfering with or otherwise degrading the performance of signals transmitted or received on the antennae. The ground plane 106 may not necessarily have to cover the top portion of the enclosure 102, but may extend past the antenna's horizontal plan area sufficiently to reduce interference.

In many cases, housing the various electrical equipment 104 in a tightly shielded enclosure is cost prohibitive. The use of nonmetallic enclosures is both easy to install as well as maintain. Additionally, nonmetallic enclosures may have certain molded-in features that reduce assembly and installation costs. With such enclosures, the energy radiation from inside the enclosure 102 may pose considerable difficulty for effectively performing radio transmissions. With this in mind, the ground plane 106 may reduce the unwanted interference of radio transmissions.

In some configurations, the ground plane 106 may incorporate mounting hardware or features that may aid installation of antennae. For example, a ground plane may have a fastener, hole, raised area, cutout area, mechanical interlocking feature, or other feature by which one or more antennae may be located and attached to the ground plane 106. The ground plane 106 may include mounting features including any type of bracketry on which an antenna may be mounted.

The antennae may be any type of radio frequency antenna. The antennae 108, 110, 112, and 114 may be panel type antennae that are configured to transmit in four separate quadrants. Any other type of antenna may be used, including dipole, rod, diversity, sectorized, parabolic, or any antenna imaginable. In some situations, multiple antennae may be designed to work independently of each other while in other situations, two or more antennae may be designed to work cooperatively, such as in a diversity antenna situation.

The antennae may have conductive connections between the antennae and the ground plane 106. In some cases, a portion of the antenna may be electrically connected to the ground plane 106, while in other cases, the antenna may electrically float with respect to the ground plane.

The radome 116 may be a nonconductive cover that protects the antennae. In many cases, the radome 116 may be manufactured from a molded or fabricated plastic that has known frequency transmission characteristics. When the frequency transmission characteristics are known, certain adjustments to the antennae and radio transceivers may be made, including power level and frequency response characteristics. In such cases, the antennae and radome combination may be specified together with the ground plane and have predictable and repeatable known performance characteristics.

The radome 116 may be attached directly to the ground plane 106 through the use of fastener holes 118 or by any other mechanical attachment. In some cases, the radome may be sealed in a weather-tight manner with gasketing to prevent water or dust infiltration. In other cases, the radome 116 may not be sealed to the enclosure 102.

In many cases, the radome 116 may prevent unwanted movement, tampering, or disruption of the antennae. In addition, the radome 116 may provide an aesthetically pleasing cover for the enclosure 102.

Figure 3:
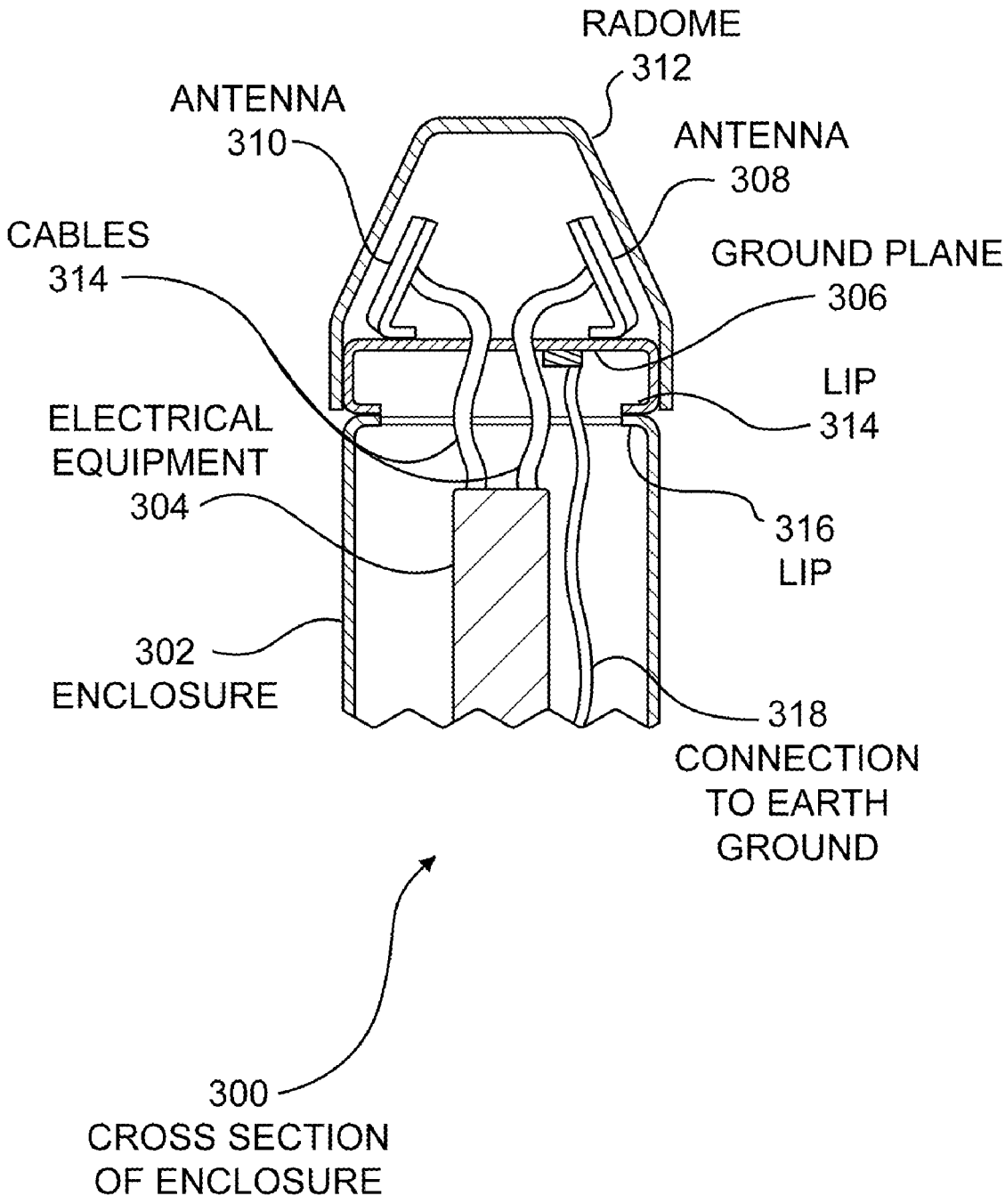
FIG. 3 is a cross-sectional view of an embodiment showing an enclosure with two antennae.

FIG. 3 is a cross-sectional illustration of an embodiment 300 showing an enclosure with antennas and a radome. The enclosure 302 contains electrical equipment 304. Attached to the top of the enclosure 302 is a ground plane 306, to which is attached antennas 308 and 310. The radome 312 covers the antennae. A connection to earth ground 318 connects the ground plane 306 to earth ground.

The radome 312 may be fashioned out of sheet material, such as sheet plastic. The radome 312 may be formed into a section as shown that comprises a lip 314. The radome 312 may be attached to the enclosure 302 by fastening through lip 314 and lip 316. In some cases, a gasket or sealant may be used between lips 314 and 316.

The cables 314 may connect the electrical equipment 304 to the antennae. The cables 314 may pass through an opening formed by the lip 316 and a hole in the ground plane 306. In some embodiments, the cables 314 may be connected through passthroughs such as panel mounted connectors or other grounded or isolated electrical connections that may minimize RF radiation through the ground plane 306.

The radome 312 may be fastened to the ground plane 306 or may be attached by any other mechanism. In some cases, the radome 312 may be extended to engage a portion of the enclosure 302 and not contact the ground plane 306.

Figure 4:
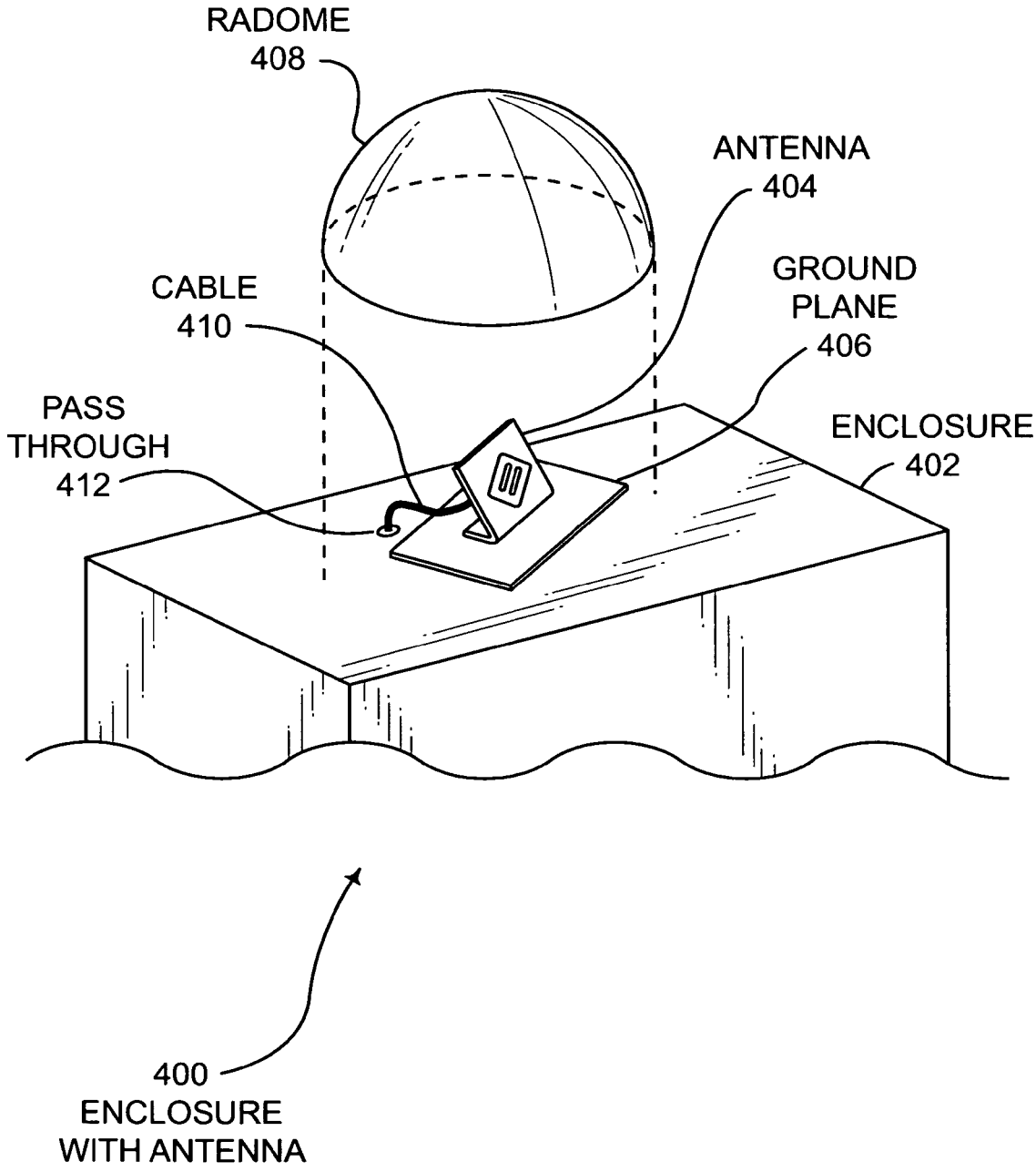
FIG. 4 is a partially exploded perspective view of an embodiment with a single antenna.

FIG. 4 illustrates an embodiment 400 showing a single antenna mounted on an enclosure. The enclosure 402 has an antenna 404 mounted on a ground plane 406. A radome 408 is shown exploded from the assembly. Cable 410 comes through the enclosure 402 through the passthrough 412.

The embodiment 400 illustrates an embodiment wherein the ground plane 406 only partially covers the top of the enclosure 402. The ground plane 406 may be 50% or more of the plan area of the antenna 404. The plan area is the projection of the antenna 404 onto the substantially horizontal surface of the ground plane 406.

Radome 408 may be attached to the enclosure 402 by any mechanical means whatsoever and need not extend to the outer boundaries of the enclosure 402.

Figure 5:
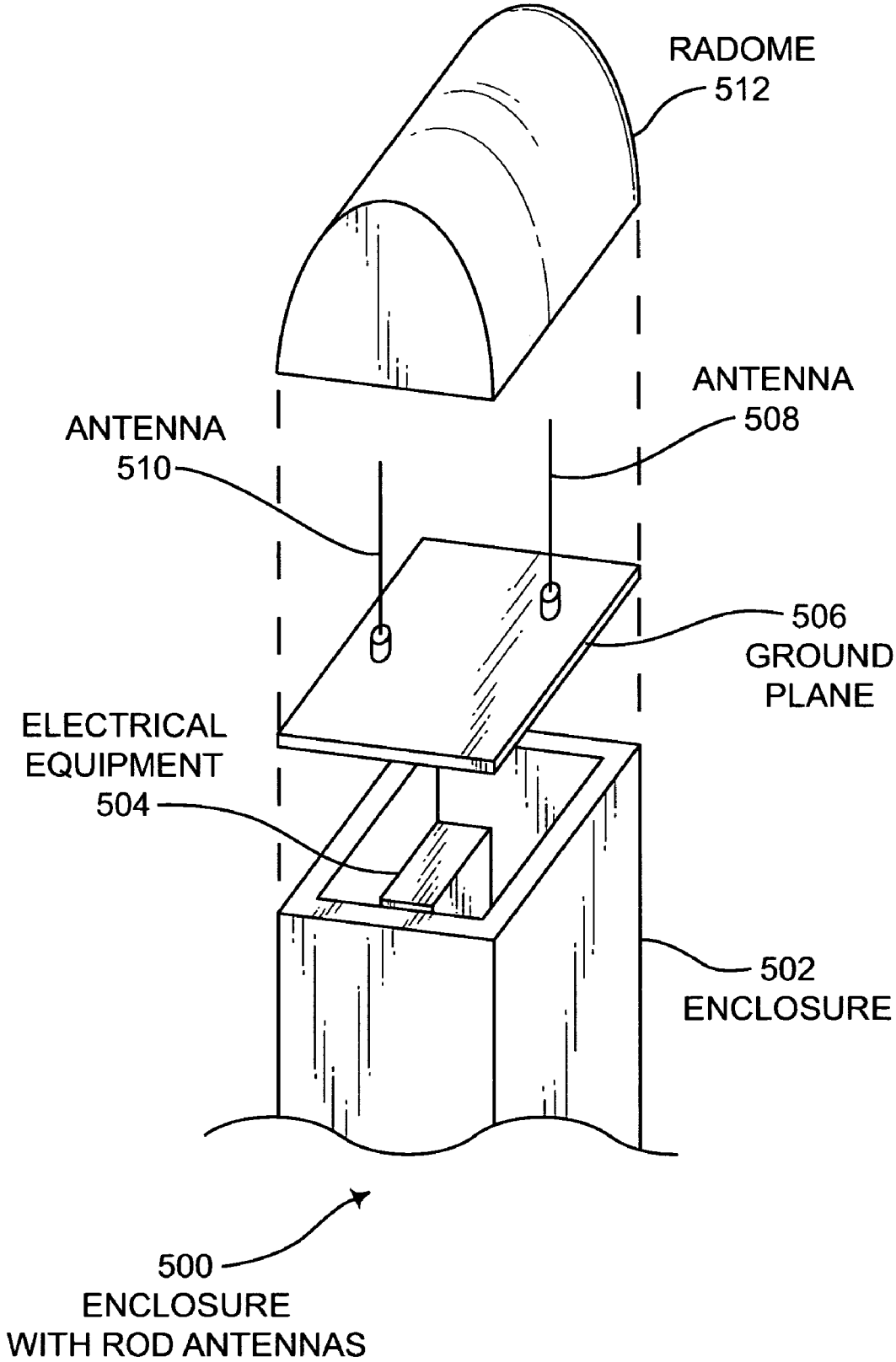
FIG. 5 is a partially exploded perspective view of an embodiment with two rod antennae.

FIG. 5 illustrates an embodiment 500 showing an enclosure with rod antennas. The enclosure 502 houses electrical equipment 504. On the top of the enclosure 502 is mounted a ground plane 506 which holds antennae 508 and 510. A radome 512 protects the antenna 508 and 510.

Embodiment 500 illustrates that any type of antenna may be used in the present invention, including rod, dipole, parabolic, planar, or any type of antenna whatsoever.

Figure 6:
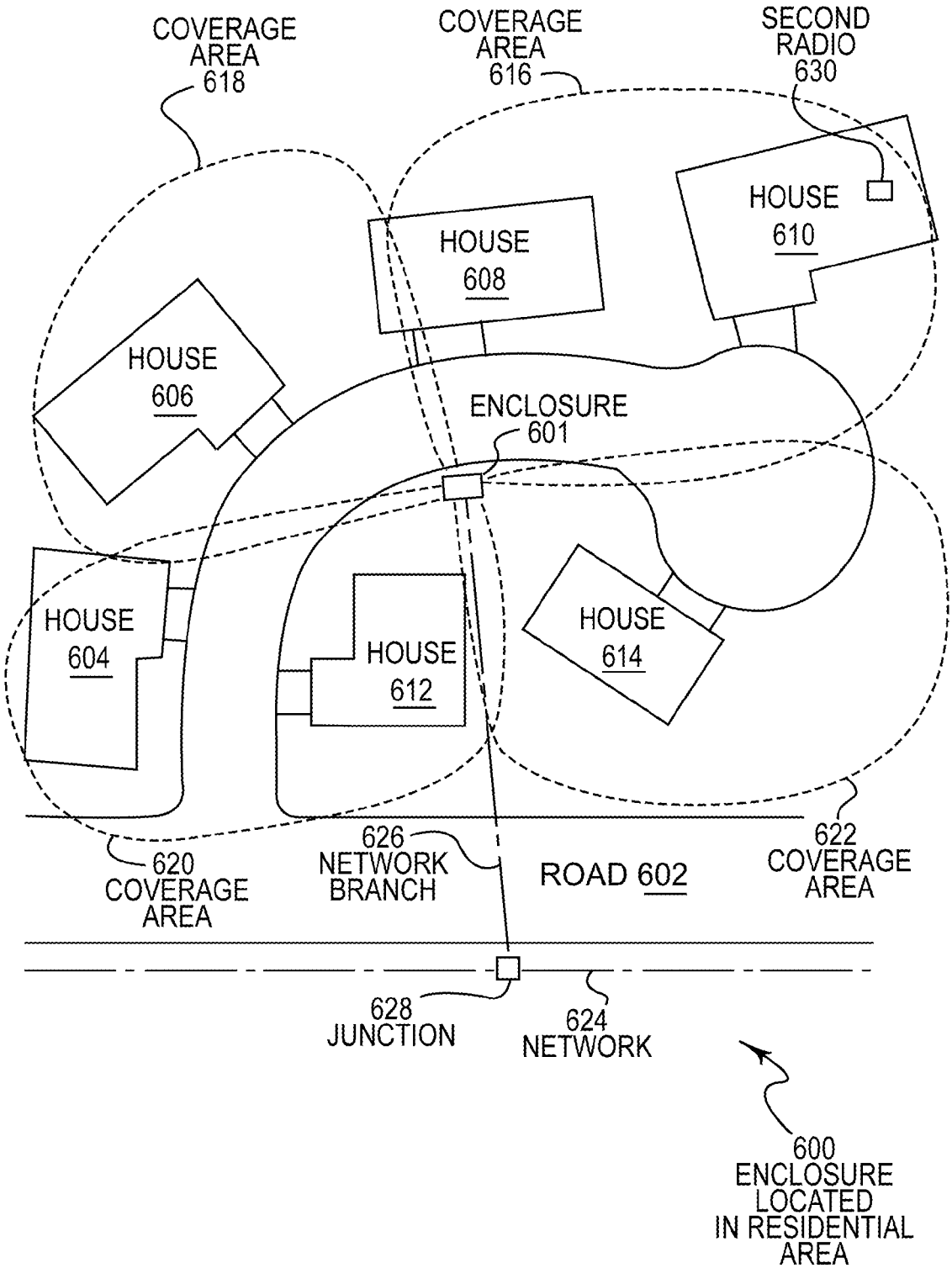
FIG. 6 is a plan view of a residential neighborhood being served by an enclosure having four antennae.

FIG. 6 illustrates a plan view of an embodiment 600 showing wireless access points deployed in a residential area. A road 602 is shown with houses 604, 606, 608, 610, 612, and 614. Enclosure 601 is mounted at a central point of the community and contains four different antennae. One antenna has coverage area 616 that encompasses house 608 and 610. House 610 may contain a second radio 630 configured to communicate with another radio in the enclosure 601. A second antenna has coverage area 618 that encompasses house 606. A third antenna has coverage area 620 that encompasses houses 604 and 612. A fourth antenna has coverage area 622 that encompasses house 614. The enclosure 601 is connected to the network 624 through a network branch 626 and junction 628.

Embodiment 600 is an application for wireless connectivity in a residential area. The enclosure 601 may provide various communications to and from the homes, such as internet data connections, voice telephony, video services, and any other communication. In many applications, the wireless access points within the enclosure 601 may use a standardized radio communications protocol, such as those defined by IEEE 802.11 specification. In other applications, different radio communications protocols, including custom or non-standard protocols, may be used. The enclosure 601 may be mounted on the ground with underground connections to the network branch 626 and power.

The enclosure 601 may contain one or more radios, each capable of one or more communication sessions. In the embodiment 600, directional antennas may be used to subdivide the total coverage area into several smaller sectors or coverage areas 616, 618, 620, and 622. Each coverage area may be covered by a separate radio.

The network 624 may be a coaxial cable, fiber optic, twisted pair, or other communications cable. In some configurations, the network 624 may be similar to a conventional cable television plant using DOCSIS or other communication protocols connected to a cable modem termination system ('CMTS'). In other configurations, the network 624 may be twisted pair digital subscriber line ('DSL') lines that are connected using a digital subscriber line area manager ('DSLAM'). Such networks may be classified as examples of linear broadband networks. In still other configurations, the network may be an Ethernet or Ethernet-type network.

In other embodiments, the network 624 may be a wireless network on the same or different frequency band and protocols as the communications with the various coverage areas. For example, a microwave or other long range radio transmission may connect the enclosure 601 with the network 624. In some situations, a microwave or other wireless connection may serve the function as a hard wired network branch 626.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An enclosure comprising:

a lower equipment housing comprising at least one mounting device for an electrical device, said lower equipment housing being substantially nonconductive and having a plurality of connections through a plurality of openings in a floor plate of said lower equipment housing, each of said plurality of said connections being through each of said plurality of openings of said floor plate;

a ground reference plate mounted substantially horizontally and above said lower equipment housing and electrically connected with earth ground by a cable, said ground reference plate defining a substantially horizontal plane on the upper surface of said ground reference plate, said earth ground comprising a direct connection to the Earth, said ground reference plate being conductive;

at least one antenna mounted above said ground reference plate, said at least one antenna connected to said electrical device through said ground reference plate;

wherein said ground reference plate comprises a substantially flat portion beneath said at least one antenna, said flat portion having a plan area substantially larger than a plan area of said antenna.

2. The enclosure of claim 1, wherein said electrical device comprises at least one of a group composed of:

an amplifier;

a transformer; and a power supply.

3. The enclosure of claim 1, wherein said connection to a network comprises at least one of a group composed of:

a coaxial cable television conductor;

a fiber optic cable television conductor; and at least one twisted pair conductor.

4. The enclosure of claim 1, said electrical device comprising a transceiver and being connected to said antenna through said first connection.

5. The enclosure of claim 4, said transceiver is adapted to send and receive communication signals one of said plurality of connections.

6. The enclosure of claim 5, one of said plurality of connections comprising a fiber optic linear broadband network.

7. The enclosure of claim 5, one of said plurality of connections comprising a coaxial linear broadband network.

8. The enclosure of claim 5, one of said plurality of connections comprising a twisted pair linear broadband network.

9. The enclosure of claim 1 wherein said plan area of said flat portion is at least 50% larger than said plan area of said antenna.

10. The enclosure of claim 1 further comprising:

a hinged door mounted below said ground reference.

11. The enclosure of claim 10 wherein said hinged door is mounted with a hinge axis substantially perpendicular to said plane.

12. The enclosure of claim 1, wherein said ground reference plate comprises at least one hole.

13. The network interface of claim 1 wherein said plan area of said flat portion is at least 50% larger than said plan area of said antenna.

14. The enclosure of claim 1, said antenna being a directional antenna.

15. The enclosure of claim 14 further comprising:

a plurality of said directional antennas.

16. The enclosure of claim 15, said plurality of directional antennas being arranged in a sectorized fashion.

17. The enclosure of claim 1 further comprising:

a radome covering said at least one antenna.

18. The enclosure of claim 17, said radome being weatherproof.

19. The enclosure of claim 17, said enclosure comprising a plurality of antennas.

20. The enclosure of claim 19, at least one of said plurality of antennas being a sectorized antenna.

21. The enclosure of claim 1, said plan area of said ground reference plate being approximately equal to a plan area of said enclosure.

22. The enclosure of claim 1, said electrical device being mounted in a vertical manner.

23. A network interface comprising:

a lower equipment housing comprising at least one mounting device for an electrical device, said electrical device comprising an interface to a network, said lower equipment housing being electrically nonconductive, said lower equipment housing having a floor plate with a plurality of openings;

a ground reference plate mounted substantially horizontally above said lower equipment housing and electrically connected with earth ground, said ground reference plate defining a substantially horizontal plane on the upper surface of said ground reference plate, said earth ground comprising a direct connection to the Earth, said ground reference plate being electrically conductive;

a plurality of directional antennas mounted above said ground reference plate, said antennas adapted to send and receive communications to a network subscriber;

a first set of connections through said ground reference plate from each of said plurality of directional antennas to said electrical device; and a second set of connections through said floor with said plurality of openings to said electrical device, at least one of said second set of connections being a network connection;

wherein said ground reference plate comprises a substantially flat portion beneath said plurality of directional antennas, said flat portion having a plan area substantially larger than a plan area of said antennas.

24. The network interface of claim 23 wherein said electrical device comprises at least one of a group composed of:

an amplifier;

a transformer; and a power supply.

25. The network interface of claim 23 wherein said interface to said network comprises a coaxial linear broadband network.

26. The network interface of claim 23 wherein said interface to said network comprises a fiber optic linear broadband network.

27. The network interface of claim 23 wherein said interface to said network comprises at least one twisted pair linear broadband network.

28. The enclosure of claim 23, said plurality of directional antennas being arranged in a sectorized fashion.

* * * * *